US012523141B2

(12) United States Patent
Darwish et al.

(10) Patent No.: US 12,523,141 B2
(45) Date of Patent: Jan. 13, 2026

(54) DOWNHOLE TOOL WITH VIBRATION DAMPENING AND/OR SHOCK ABSORPTION

(71) Applicant: Schlumberger Technology Corporation, Sugar Land, TX (US)

(72) Inventors: Ibrahim Darwish, Stonehouse (GB); Dean Gardner, Clifton (GB); Michael Barker, Stonehouse (GB); Nadia Domanski, Cheltenham (GB)

(73) Assignee: Schlumberger technology Corporation, Sugar Land, TX (US)

( * ) Notice: Subject to any disclaimer, the term of this patent is extended or adjusted under 35 U.S.C. 154(b) by 0 days.

(21) Appl. No.: 18/977,520

(22) Filed: Dec. 11, 2024

(65) Prior Publication Data

US 2025/0198279 A1 Jun. 19, 2025

Related U.S. Application Data

(60) Provisional application No. 63/609,477, filed on Dec. 13, 2023.

(51) Int. Cl.
*E21B 47/017* (2012.01)
*E21B 7/04* (2006.01)

(52) U.S. Cl.
CPC ..... *E21B 47/017* (2020.05); *E21B 7/04* (2013.01)

(58) Field of Classification Search
CPC ..... E21B 47/017; E21B 7/04
See application file for complete search history.

(56) References Cited

U.S. PATENT DOCUMENTS

| | | | | |
|---|---|---|---|---|
| 4,953,398 | A * | 9/1990 | Masson | G01V 1/46 73/152.58 |
| 7,036,363 | B2 * | 5/2006 | Yogeswaren | G01N 29/2468 73/152.58 |
| 8,646,519 | B2 * | 2/2014 | Johanning | E21B 47/017 29/447 |
| 10,012,077 | B2 * | 7/2018 | Xia | E21B 47/017 |
| 10,458,226 | B2 * | 10/2019 | Kuroiwa | E21B 47/017 |
| 10,815,771 | B2 * | 10/2020 | Shahan | F16F 15/02 |
| 11,274,542 | B2 * | 3/2022 | He | F16F 15/08 |
| 2018/0179830 | A1 * | 6/2018 | Konschuh | E21B 17/07 |
| 2019/0145244 | A1 | 5/2019 | Moriarty | |

* cited by examiner

*Primary Examiner* — Aaron L Lembo

(57) ABSTRACT

A downhole tool for drilling a wellbore in a subterranean formation is described. The downhole tool includes a mounting block or chassis that experiences vibrations when drilling and at least one sensor or electronics assembly mechanically coupled to the mounting block or chassis by at least one vibration damper element.

24 Claims, 16 Drawing Sheets

Section Cut at A-A

Section Cut at B-B

DOWNHOLE TOOL WITH VIBRATION DAMPENING AND/OR SHOCK ABSORPTION

CROSS-REFERENCE TO RELATED APPLICATION(S)

The present disclosure claims priority from U.S. Provisional Appl. No. 63/609,477, filed on Dec. 13, 2023, herein incorporated by reference in its entirety.

FIELD

The present disclosure relates generally to downhole tools, such as rotary steerable systems (RSS), measurement-while-drilling (MWD) tools and logging-while-drilling (LWD) tools, which are used for drilling wellbores in oil and gas exploration and production.

BACKGROUND

Directional drilling operations involve controlling the direction of a wellbore as it is being drilled. Usually, the goal of directional drilling is to reach a target subterranean destination with a drill string, and often the drill string will need to be turned through a tight radius to reach the target destination. Generally, a rotary steerable system (RSS) changes drilling direction either by pushing against one side of a wellbore wall with steering pads to thereby cause the drill bit to push on the opposite side (in a push-the-bit RSS), or by bending a main shaft running through a housing to point the drill bit in a particular direction with respect to the rest of the tool (in a point-the-bit RSS). An RSS employs sensors (typically accelerometers, gyroscope(s), and magnetometer(s)) and associated electronics to measure and store tool parameter data, such as data representing inclination angle, azimuth angle and toolface of the RSS. Such tool parameter data can be used to control the drilling direction in real-time while drilling a wellbore.

Drilling systems, including directional drilling systems, can also employ measurement-while-drilling (MWD) tools that provide real-time measurements of physical properties, typically including pressure, temperature and wellbore trajectory in three-dimensional space, while drilling a wellbore. An MWD tool typically employs sensors, such as gyroscopes, accelerometers, and magnetometer(s), and associated electronics to measure and store data related to wellbore trajectory during the drilling.

Drilling systems, including directional drilling systems, can also employ logging-while-drilling (LWD) tools that provide real-time measurements of formation properties while drilling a wellbore. The LWD tools typically include one or more sensors and associated electronics used to measure and store data representing various formation properties.

A drilling system, including an RSS, MWD tool(s) and/or LWD tool(s) that are part of the drilling system, can experience high vibration and/or shock conditions when drilling. These conditions can lead to degradation or failure of these tools which limits the operational lifetime of the tools. Such conditions can also degrade the accuracy of sensor measurements performed by these downhole tools and/or increase current drawn by the sensor(s) and thus increase the electrical load of these downhole tools.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In embodiments, a downhole tool for drilling a wellbore in a subterranean formation is provided, which includes a mounting block or chassis that experiences vibrations when drilling; and at least one sensor or electronics assembly mechanically coupled to the mounting block or chassis by at least one vibration damper element.

In embodiments, the vibration damper element can be arranged in a sunken configuration wherein a first part of damping material of the vibration damper element is disposed within a recess or hole in the mounting block or chassis, and a second part of the damping material of the vibration damper element extends above the recess or hole in the mounting block or chassis.

In embodiments, the first part of the damping material of the vibration damper element disposed within the recess or hole in the mounting block or chassis can be a major portion of the damping material of the vibration damping element.

In embodiments, the at least one sensor or electronics assembly can be mechanically coupled to the mounting block or chassis by a plurality of vibration damper elements.

In embodiments, the at least one vibration damper element can be configured to mechanically couple at least one sensor to the mounting block or chassis.

In embodiments, the downhole tool can include at least one shock bumper that surrounds a corresponding sensor. The shock bumper can be configured to absorb shock experienced by the mounting block or chassis when drilling. The shock bumper can have at least one opening that provides a passageway for a corresponding vibration damper element to pass therethrough.

In embodiments, the at least one sensor can include an accelerometer sensor.

In embodiments, the at least one vibration damper element can function to reduce current drawn by the at least one sensor.

In embodiments, the at least one vibration damper element can function to reduce drift in the measurements performed by the at least one sensor.

In embodiments, the at least one vibration damper element can act as a mechanical low pass filter with regards to measurements performed by the at least one sensor.

In embodiments, the at least one vibration damper element comprises a plurality of vibration damper elements configured to mechanically couple an electronics assembly to a chassis.

In embodiments, the electronics assembly includes a printed wire assembly or printed circuit board.

In embodiments, the at least one vibration damper element can be a turret-mounted damper element that includes a top post and a bottom post that extend from top and bottom plates, respectively, which are mounted to opposed surfaces of a cylindrical damping structure.

In embodiments, the downhole tool can be a tool selected from the group consisting of a rotary steerable system, a measurement-while drilling tool, a logging-while drilling tool, or other downhole tool.

In another aspect, a downhole tool for drilling a wellbore in a subterranean formation includes a mounting block that experiences vibrations when drilling. The mounting block can include at least one primary recess configured to receive a corresponding sensor and a plurality of secondary recesses disposed about the primary recess. The at least one sensor can be mechanically coupled to the mounting block by a plurality of vibration damper elements disposed within the plurality of secondary recesses.

In embodiments, at least one of the plurality of vibration damper elements can be arranged in a sunken configuration wherein a first part of damping material of the respective vibration damper element is disposed within a corresponding secondary recess, and a second part of the damping material of the respective vibration damper element extends above the corresponding secondary recess.

In embodiments, the first part of the damping material of the respective vibration damper element that is disposed within the corresponding secondary recess can be a major portion of the damping material of the respective vibration damping element.

In embodiments, a shock bumper can be disposed within the primary recess and configured to surround the corresponding sensor and absorb shock experienced by the mounting block when drilling.

In embodiments, the at least one sensor includes an accelerometer sensor.

In embodiments, the plurality of vibration damper elements can function to reduce current drawn by the at least one sensor.

In embodiments, the plurality of vibration damper elements can function to reduce drift in the measurements performed by the at least one sensor.

In embodiments, the plurality of vibration damper elements can act as a mechanical low pass filter with regards to measurements performed by the at least one sensor.

In embodiments, at least one of the plurality of vibration damper elements can be a turret-mounted damper element that includes a top post and a bottom post that extend from top and bottom plates, respectively, which are mounted to opposed surfaces of a cylindrical damping structure.

In embodiments, the downhole tool can be a tool selected from the group consisting of a rotary steerable system, a measurement-while drilling tool, a logging-while drilling tool, or other downhole tool.

BRIEF DESCRIPTION OF THE DRAWINGS

The subject disclosure is further described in the detailed description which follows, in reference to the noted plurality of drawings by way of non-limiting examples of the subject disclosure, in which like reference numerals represent similar parts throughout the several views of the drawings as follows:

FIG. 4 is an exploded schematic view of the part; FIG. 5 is a perspective schematic view of the part; FIG. 6 is a side schematic view of the part; FIG. 7 is a sectional schematic view of the part along a section labeled A-A in FIG. 6; FIG. 8 is an enlarged view of a portion of the sectional schematic view of the part of FIG. 7; and FIG. 9 is a sectional schematic view of the part along a section labeled B-B in FIG. 6;

FIG. 17 is an exploded schematic view of the part; FIG. 18 is a perspective schematic view of the part; and FIG. 19 is a side schematic view of the part.

DETAILED DESCRIPTION

Figure 1:
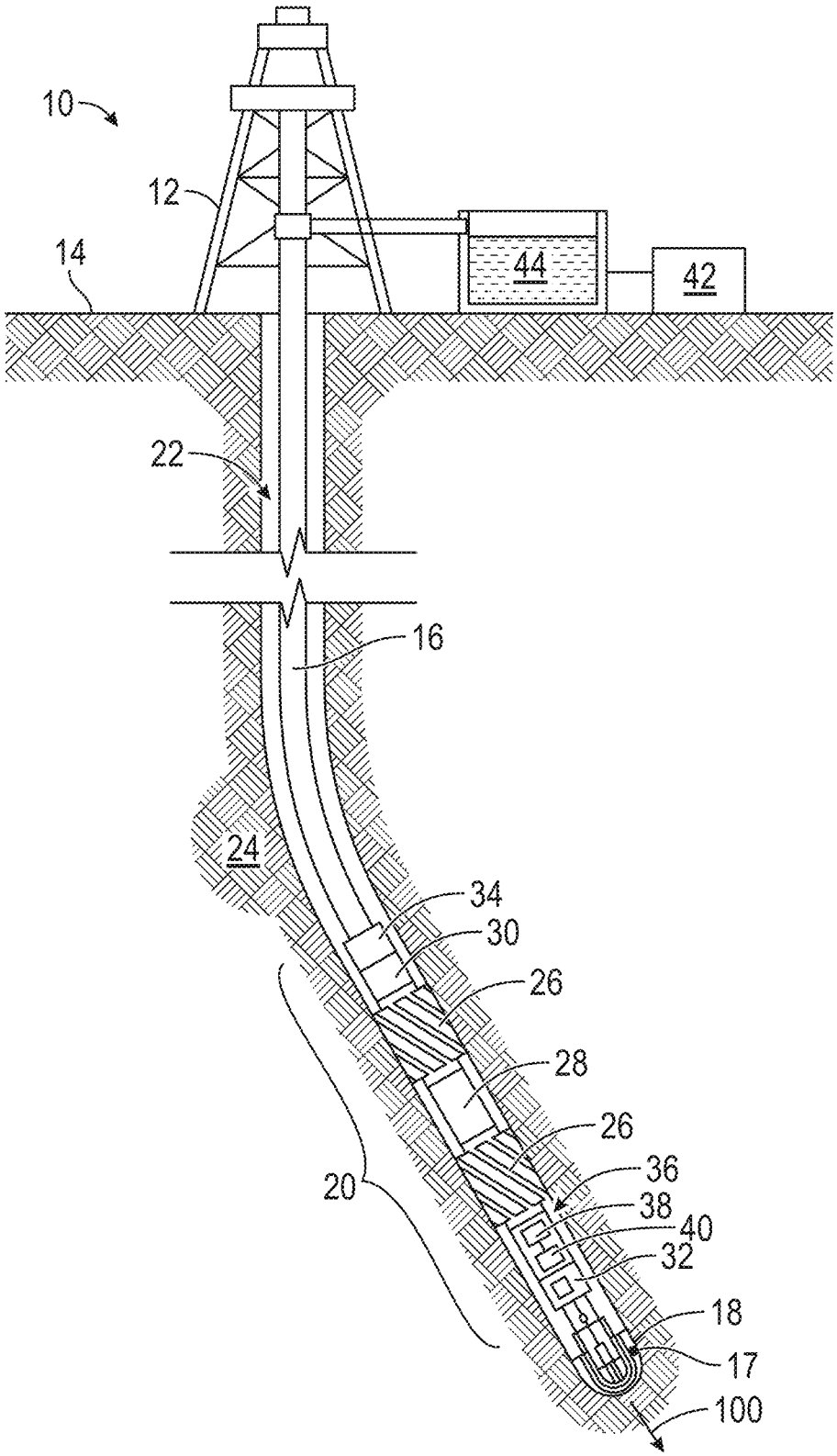
FIG. 1 is a schematic diagram of a directional drilling system that can embody aspects of the present disclosure.

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and will not in itself dictate a relationship between the various embodiments and/or configurations discussed.

As used herein, the terms connect, connection, connected, in connection with, and connecting may be used to mean in direct connection with or in connection with via one or more elements. Similarly, the terms couple, coupling, coupled, coupled together, and coupled with may be used to mean directly coupled together or coupled together via one or more elements. Terms such as up, down, top and bottom and other like terms indicating relative positions to a given point or element may be utilized to describe some elements. Commonly, these terms relate to a reference point such as the surface from which drilling operations are initiated.

A directional drilling process creates one or more wellbores in a subterranean formation by steering a drill bit along a planned path or trajectory. A directional drilling system can utilize a rotary steering system (RSS) to steer the drill bit and to create one or more wellbores along the desired path (i.e., trajectory). Rotary steering systems may be classified generally, for example, as a push-the-bit systems or point-the-bit systems. Push-the-bit systems use pads on the outside of the downhole tool which contact the wellbore wall and apply a side force to the wellbore wall to cause a change in the direction of the drilling of the drill bit. Point-the-bit systems change the direction of the drill bit relative to the rest of the tool by bending a main shaft running through it. The latter require some kind of non-rotating housing or reference housing in order to bend the main shaft.

The downhole tools of the drilling system can experience vibrations and shock events during drilling operations, which can be caused by cutting forces at the drill bit or mass imbalances in the downhole tools such as drilling motors. Such vibrations and shock events can result in reduced quality of measurements made by downhole tools and can result in wear, fatigue, and/or failure of the downhole components. As appreciated by those of skill in the art, different vibrations exist, such as lateral vibrations, axial vibrations, and torsional vibrations. As used herein, the terms "vibration" and "vibrations" refer to repeated and/or periodic movements or periodic deviations of a mean value, such as a mean position, a mean velocity, and a mean acceleration. In particular, these terms are not meant to be limited to harmonic deviations, but may include all kinds of deviations, such as, but not limited to periodic, harmonic, and statistical deviations. Vibration is commonly expressed in terms of frequency (cycles per second or Hz) and amplitude, which is the magnitude of the deviation. As used herein, the term "shock event" or "shock" refers to motion in which there is a sharp, nearly sudden change in velocity.

FIG. 1 is a schematic illustration of a directional drilling system, generally denoted by the numeral 10. Directional drilling system 10 includes a rig 12 located at surface 14 and a drill string 16 suspended from rig 12. A drill bit 18 terminates a bottom hole assembly (BHA) 20 that is deployed on drill string 16 to drill a wellbore 22 into formation 24, for example, in the direction 100 as shown. The drill bit 18 includes cutting elements 17.

The BHA 20 includes one or more stabilizers (two shown as 26), a measurement-while-drilling (MWD) tool or sub 28, a logging-while-drilling (LWD) tool or sub 30, an RSS 32, and a power generation module or sub 34.

The MWD tool or sub 28 provides real-time measurements of physical properties, such as pressure, temperature and wellbore trajectory in three-dimensional space while drilling a wellbore. The MWD tool or sub 28 can employ sensors (such as gyroscopes, accelerometers, and magnetometer(s)) and associated electronics to determine data that represents wellbore trajectory during the drilling.

The LWD tool or sub 30 provides real-time measurements of formation properties while drilling a wellbore. The LWD tool or sub 30 can include one or more sensors and associated electronics to determine data representing various formation properties. For example, the sensor(s) can include, but are not limited to, electromagnetic sources and receivers used to characterize formation resistivity and borehole imaging, one or more acoustic sources and receivers used to characterize formation sonic properties and borehole imaging, one or more gamma ray receivers used to characterize naturally occurring gamma radiation found in a formation (typically for correlation with existing open hole logs and depth correlation), one or more gamma ray sources and receivers used to characterize formation density and lithographic boundaries (when used in combination with formation porosity from a neutron log), one or more neutron sources and neutron/gamma ray receivers used to measure hydrogen content and formation porosity, a pulsed neutron source and gamma ray receivers used to measure formation lithographic properties and relative elemental concentrations in the formation (which are indicative of oil, salinity, lithology, porosity and clay), an NMR sensor used to measure porosity, permeability, and fluid identification and fluid characterization of the formation, and sensors that analyze formation fluid samples obtained while drilling.

The RSS 32 includes a controller 36 that is operationally configured to control the orientation of the drill bit 18 to drill the wellbore 22 along the desired path. In embodiments, the controller 36 can include a downhole processor 38 and sensors 40 (such as accelerometers, gyroscope(s), and magnetometer(s)) that cooperate to determine data representing tool parameters, such as inclination angle, azimuth angle and toolface of the RSS 32. Such data can be used to control the drilling direction in real-time while drilling a wellbore. According to an embodiment, controller 36 can be a closed-loop system that interfaces directly with sensors 40 and MWD sub 28 to control the drilling direction 100.

Directional drilling system 10 also includes drilling fluid or mud 44 that can be circulated from surface 14 through the axial bore of drill string 16 and returned to surface 14 through the annulus between drill string 16 and formation 24.

The drilling direction 100 can be controlled by commands inputted (i.e., transmitted) from a directional driller or trajectory controller generally identified as the surface controller 42 (e.g., processor). Signals may be transmitted, for example via mud pulse telemetry, wired pipe, acoustic telemetry, and wireless transmissions. Accordingly, upon directional inputs from surface controller 42, controller 36 controls the drilling direction of wellbore 22 through a downhole closed loop, for example by operating the RSS 32.

Figure 2:
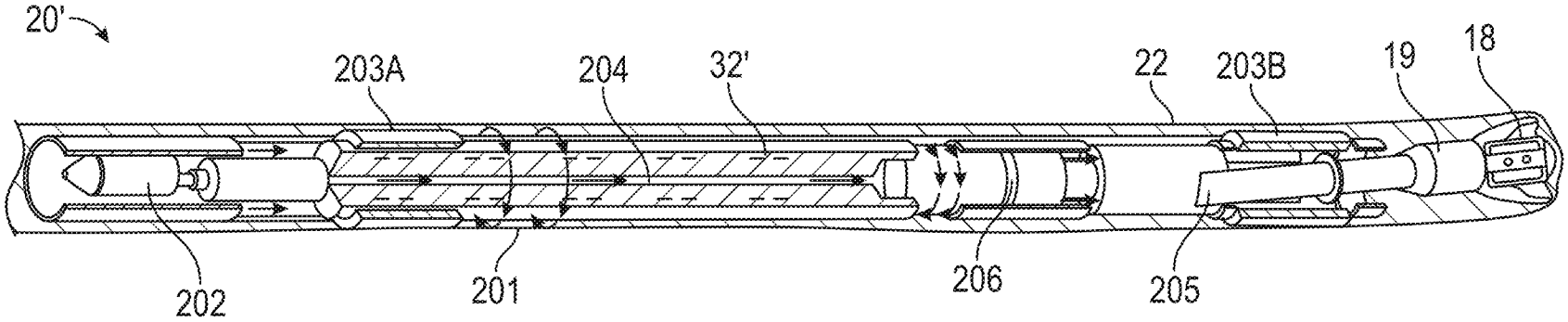
FIG. 2 is a schematic diagram of a bottom hole assembly including a rotary steerable system that can embody aspects of the present disclosure.

FIG. 2 is a schematic diagram of a bottom hole assembly 20' including RSS 32' that can embody aspects of the present disclosure. The RSS 32' is operably coupled to drill bit 18 by bit-sub 19. The RSS 32' is a point-the-bit system that is driven by a drill string (or other means) and commercially available by SLB of Houston, Texas under the name PowerDrive Xceed RSS. The RSS 32' includes a collar 201 with all internal modules and parts and the collar 201 rotating at the same speed as the drill string and drill bit 18. The collar 201 has two threaded shoulders for mounting two sleeve stabilizers 203A, 203B thereon. Along with the drill bit 18, the two sleeve stabilizers 203A, 203B provide three points of contact with the formation that determine directional response of the RSS 32'.

The RSS 32' includes a power generation turbine 202 internal to the collar 201. The power generation turbine 202 generates electrical power from the flow of drilling fluid over the turbine 202. The RSS 32' also includes electronics that include sensors and control systems 204 for the operation and control of the RSS 32'. The RSS 32' includes an offset bit shaft 205 that is oriented to provide a tool face offset at the drill bit 18 which determines the drilling direction. More specifically, the bit shaft 205 is coupled to an electric motor 206 slightly off-center from the tool axis.

This results in an offset at the bit sub 19 and, thus, at the bit 18 itself. To hold a given tool face, the electric motor 206 is rotated at exactly the same speed as the collar 201 but in the opposite direction. The net result is that the offset of the bit shaft 205 remains stationary relative to the wellbore. The tool will then drill in this direction. The time the offset position is constant over a given period determines the tool's dogleg capability. The collar 201 transmits drill string RPM, torque, and weight into the bit shaft and to the drill bit 18 by a universal joint arrangement disposed above the bit sub 19. The tool's internal components are thus protected from the forces generated by the drilling process.

Figure 3:
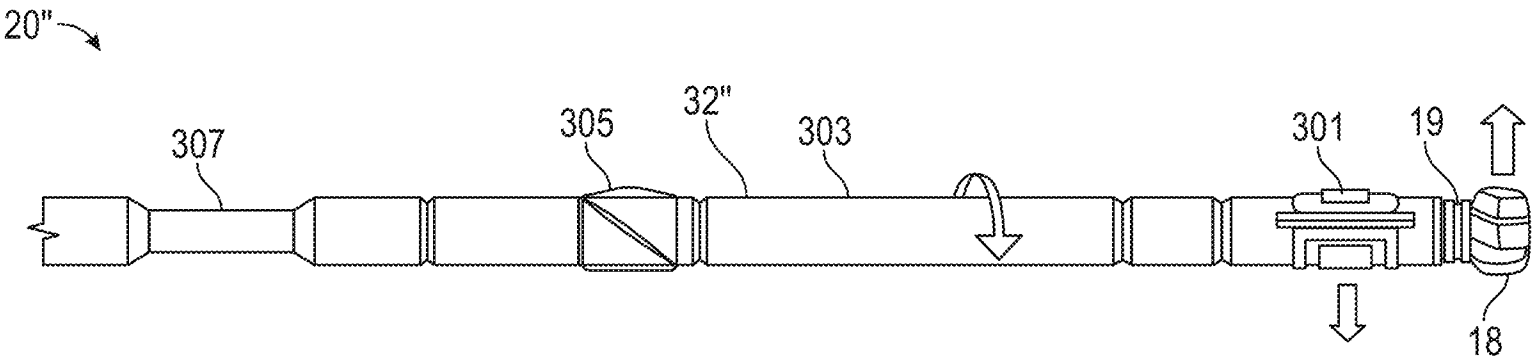
FIG. 3 is a schematic diagram of a bottom hole assembly including another rotary steerable system that can embody aspects of the present disclosure.

FIG. 3 is a schematic diagram of a bottom hole assembly 20" including another rotary steerable system 32" that can embody aspects of the present disclosure. The RSS 32" is operably coupled to drill bit 18 by bit sub 19. The RSS 32" is a push-the-bit system that is driven by a drill string (or other means) and commercially available by SLB of Houston, Texas under the name PowerDrive X5 RSS. The RSS 32" includes four main components: a bias unit 301, a control unit 303, a stabilizer 305 and an optional flex joint 307. These components all rotate at the same speed as the drill string and the drill bit 18. The bias unit 301 includes an internal rotary valve controlling hydraulic actuation of three externally mounted pads that rotate with the drill bit 18 and contact the wellbore wall and provide controlled deflection of the drill bit 18. The control unit 303 houses an electronics package with sensors and control systems used to control the bias unit 301 for control over the deflection of the drill bit 18. The stabilizer 305 rotates with the drill string and the drill bit 18 and acts as an additional point of contact with the wellbore wall for directional control. Different types of stabilizers (such as integral blade stabilizer or sleeve stabilizer) can be mounted on the bottom hole assembly 20". The optional flex joint 307 can be integrated into the bottom hole assembly 20" to increase the dogleg capability of the system.

The control unit 303 houses the electronics package with the sensor instrumentation and electronics required to control the tool's behavior. Attached to the downhole end of the control unit 303 is a control shaft that runs down into the bias unit 301. The control unit 303 can derive electrical power from the flow of drilling fluid across an impeller or from other means.

Figure 4:
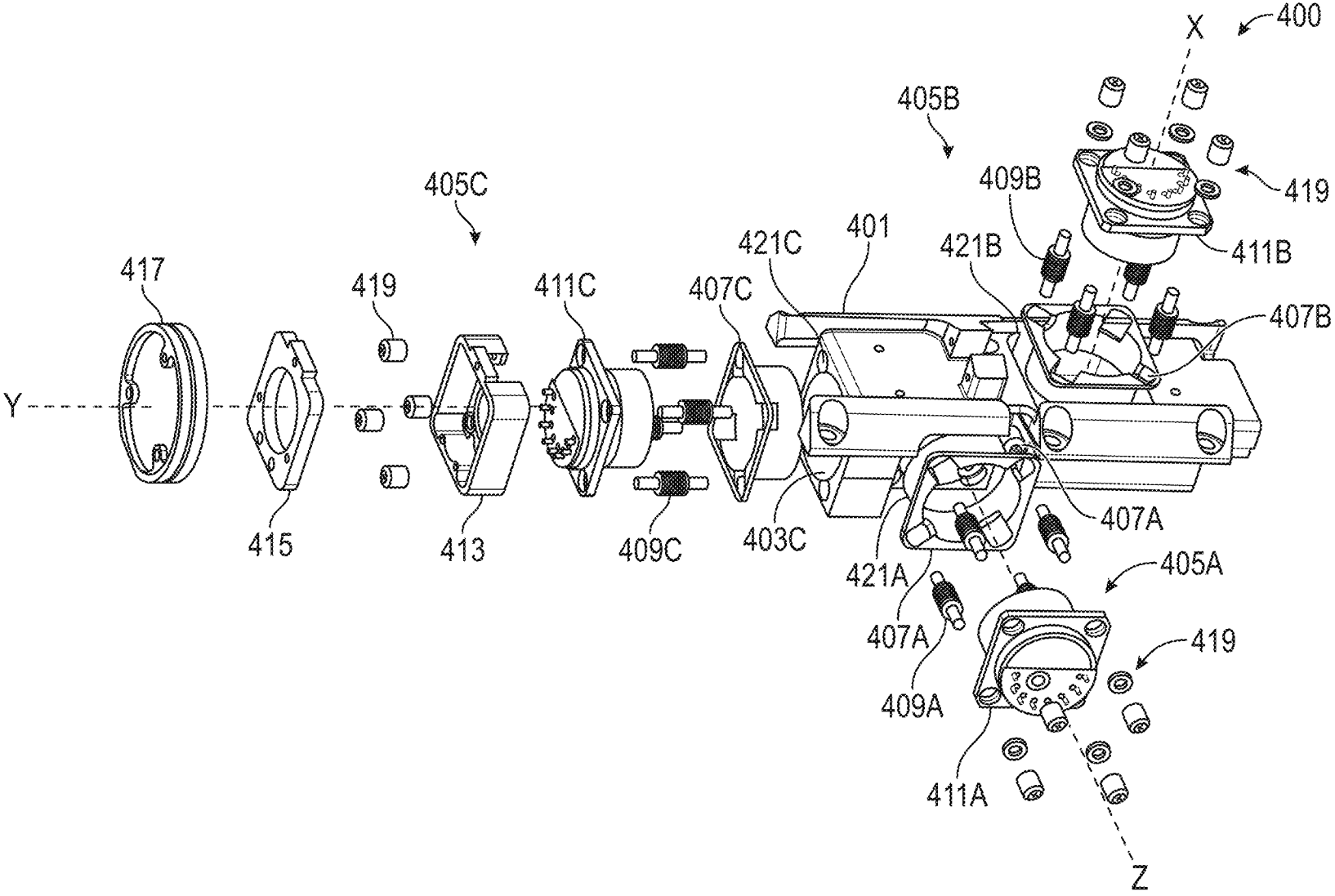
FIGS. 4 to 9 are schematic diagrams of a part of a downhole tool that can embody aspects of the present disclosure.
Figure 5:
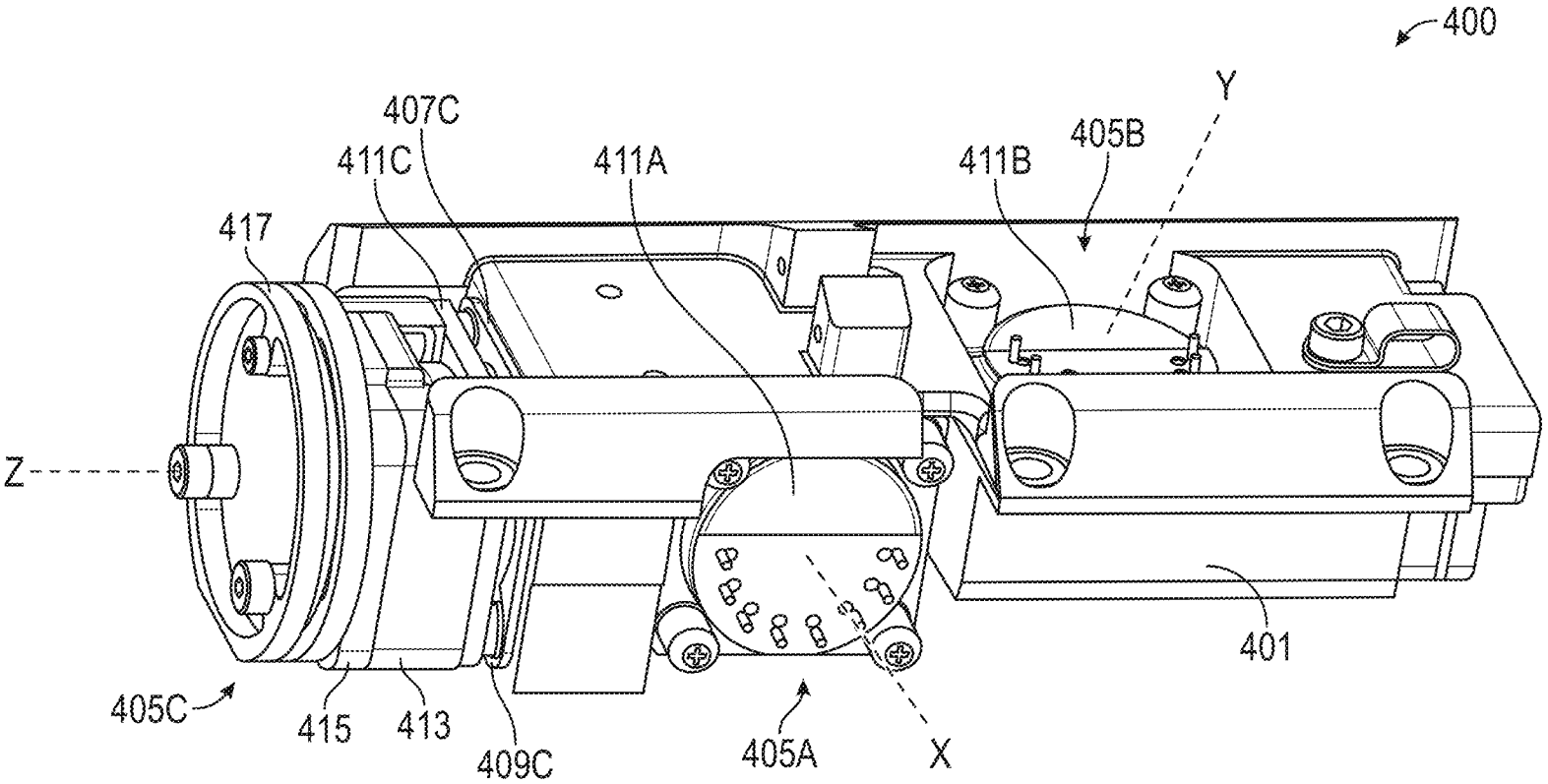
Figure 6:
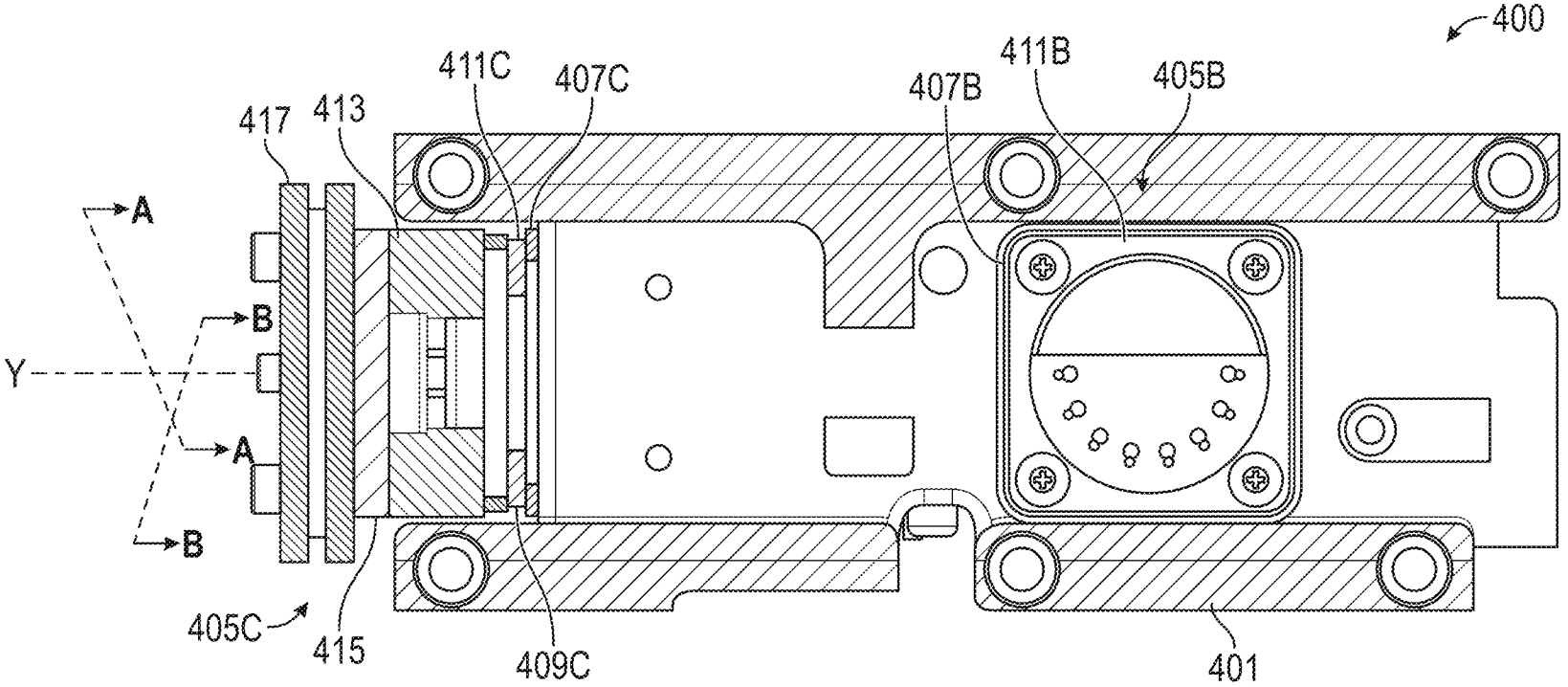
Figure 7:
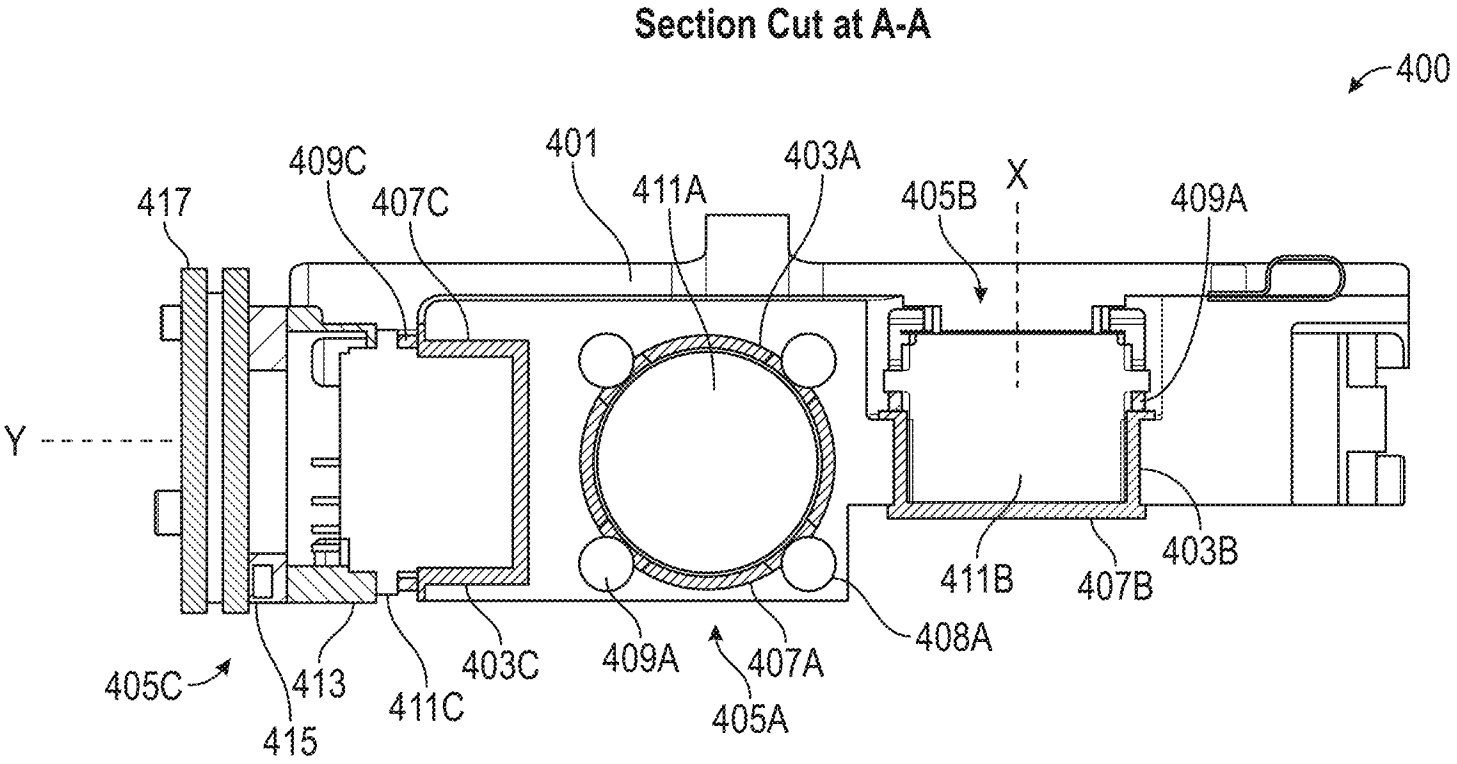
Figure 8:
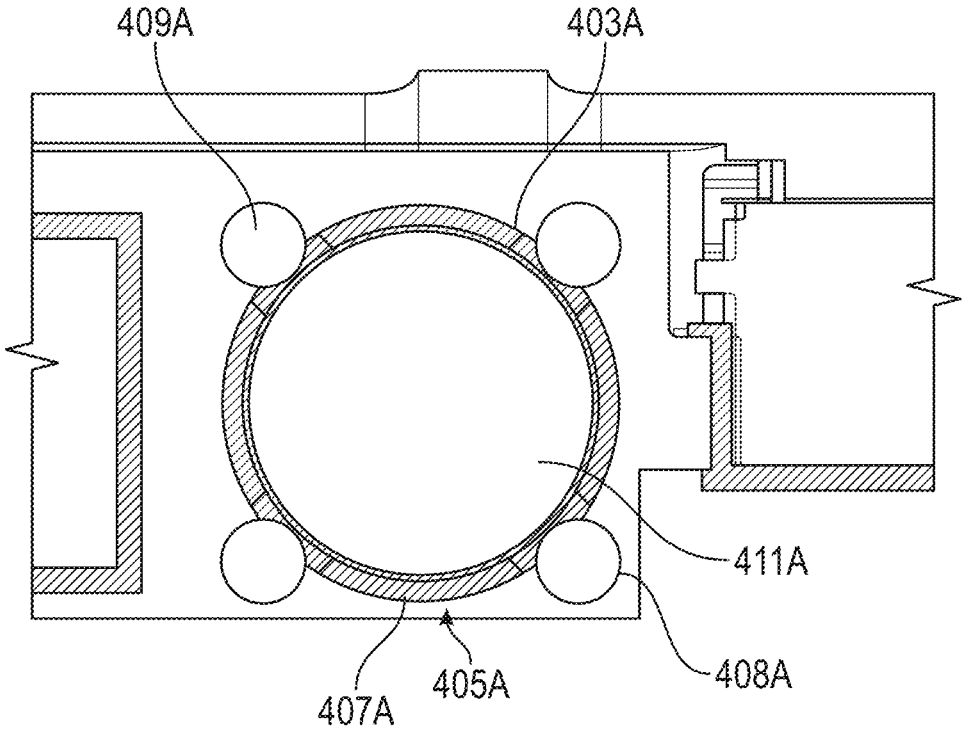
Figure 9:
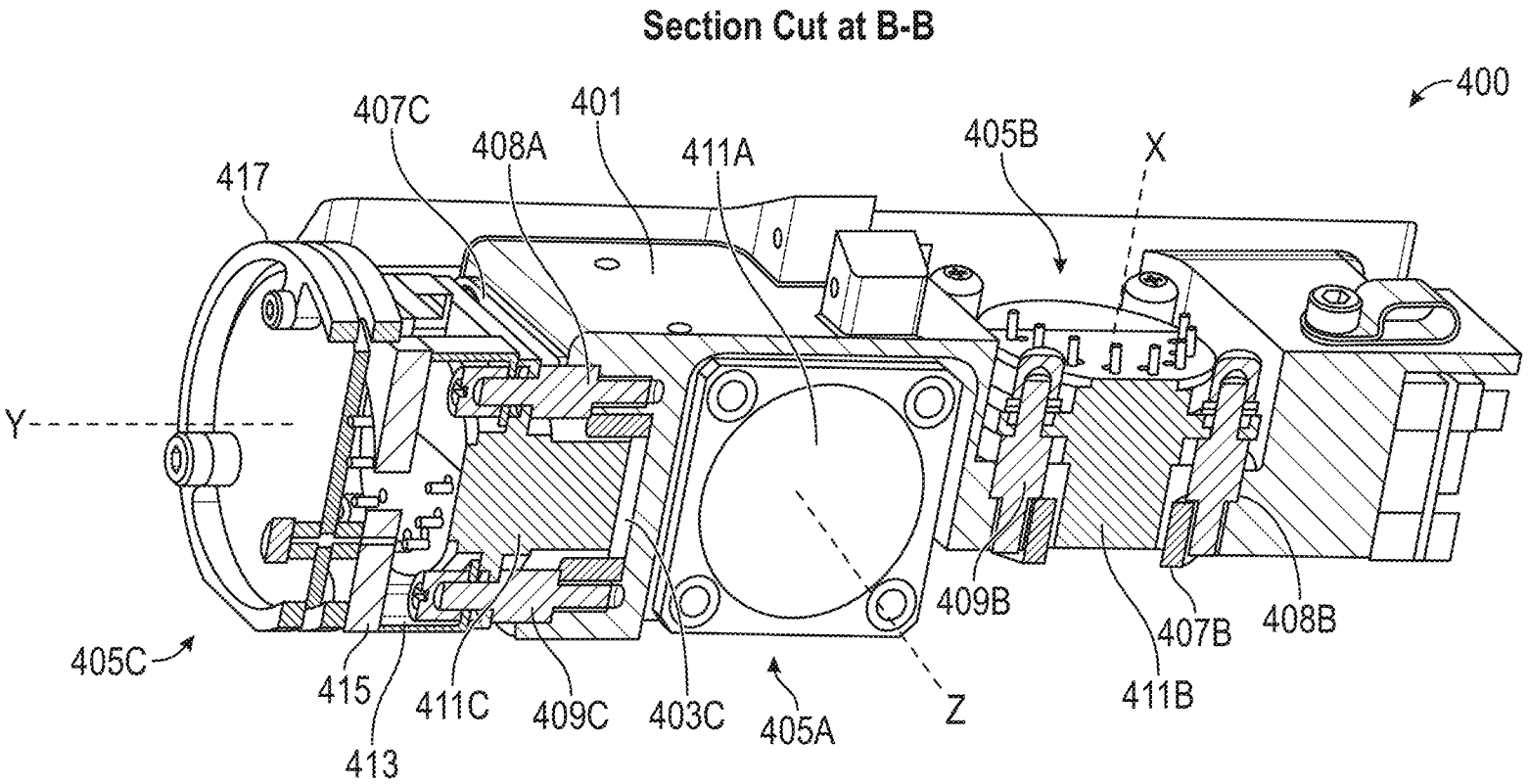

FIGS. 4 to 9 are schematic diagrams of a part of a downhole tool that can embody aspects of the present disclosure. For example, the part can be a component of an RSS or MWD tool or LWD tool, such as a component of the RSS 32 of FIG. 1, a component of the sensor package and control system of the point-the-bit RSS 32' of FIG. 2, a component of the control unit 303 of the push-the-bit RSS 32" of FIG. 3, a component of the MWD sub of FIG. 2, or a component of the LWD sub 30 of FIG. 2. The part 400 includes a mounting block 401, which is mechanically fastened or secured to a chassis or tool body of the downhole tool (not shown). As best shown in FIG. 4, the mounting block 401 includes three primary recesses or holes 403A, 403B, 403C that are configured to receive a set of three accelerometer assemblies 405A, 405B, 405C for measuring acceleration in three orthogonal axes (labeled Z, X, Y) as shown. The measurements of acceleration in the three orthogonal axes (labeled Z, X, Y) can be used to determine orientation of the tool with respect to gravity during drilling operations.

The accelerometer assembly 405A includes a shock bumper 407A, a set of damper elements (e.g., four damper elements) 409A, and an accelerometer sensor 411A. The shock bumper 407A has a top flange that extends outward from the perimeter of a cylindrical sidewall as shown. In use, the cylindrical sidewall interfaces to the annular wall of the corresponding primary recess 403A with a gap between the cylindrical sidewall and the outer sidewall of the accelerometer sensor 411A. In embodiments, this gap can be in the range of 0.125 mm to 0.425 mm, and more preferably about 0.300 mm. The top flange of the shock bumper 407A includes a set of openings (e.g., four openings) that are aligned with a corresponding set of secondary holes or recesses (e.g., four holes) 408A formed in the mounting block 401 about the periphery of the primary recess 403A. This set of secondary holes or recesses 408A of the mounting block 401 are configured to receive and mechanically support the set of damper elements (e.g., four damper elements) 409A with a gap between the outer sidewalls of the damper elements 409A and the inner walls of the mounting block 401 that forms the holes or recesses 408A. In embodiments, this gap can be in the range of 0.15 mm to 0.20 mm. The set of openings in the top flange of the shock bumper 407A permit passage of the set of damper elements (e.g., four damper elements) 409A therethrough. The accelerometer sensor 411A includes a mounting flange with a set of openings that is aligned with both the secondary holes (e.g., four holes) 408A of the mounting block 401 and the openings in the top flange of the shock bumper 407A. The openings in the mounting flange of the accelerometer sensor 411A are configured to receive the set of damper elements (e.g., four damper elements) 409A (which pass through the holes in the top flange of the shock bumper 407A) and provide for mechanical coupling of the accelerometer sensor 411A to the mounting block 401 via the set of damper elements 409A disposed therebetween. In embodiments, the top portions (i.e., top posts) of the damper elements 409A can extend through the openings in the mounting flange of the accelerometer sensor 411A. Nuts (with optional washers) 419 can be mechanically fastened to such top portions (i.e., top posts) to mechanically couple the accelerometer sensor 411A to the mounting block 401 via the set of damper elements 409A disposed therebetween.

In embodiments, the shock bumper 407A can be configured to limit motion of the accelerometer sensor 411A during high shock events (such as shock events of 350 times gravity or more) and also prevent direct contact of the accelerometer sensor 411A to the mounting block 401. The shock bumper 407A can be configured to aid in absorbing energy from shock events to improve the survivability of the accelerometer sensor 411A and can also prevent premature failure of the damper elements 409A due to excessive motion under high level shock events. In embodiments, the shock bumper 407A or part(s) thereof can be formed from an elastomeric material suitable for high temperature downhole conditions, such as high temperature silicon rubber and other high temperature rubber-like compounds (e.g., FKM or fluorine rubber or hydrogenated nitrile butadiene rubber, or VITON rubber). The thickness of the material of the shock bumper 407A can be varied by design. In one embodiment, the shock bumper 407A can be formed from 1.6 mm thick high temperature low compression rubber.

In embodiments, the damper elements 409A or parts thereof can be formed from a damping or elastomeric material suitable for high temperature downhole conditions, such as high temperature silicone rubber and other high temperature rubber-like compounds (e.g., FKM or fluorine rubber or hydrogenated nitrile butadiene rubber, or VITON rubber). In embodiments, the damper elements 409A can be configured such that a bottom part of the damping or elastomeric material of each respective damper element 409A is sunk or disposed within the corresponding hole or recess 408A in the mounting block 401 that mechanically supports the respective damper element 409A, and the top part of the damping or elastomeric material of each respective damper element 409A extends above the corresponding hole or recess 408A in the mounting block 401. This sunken configuration can enable the damper elements 409A to bend instead of shearing, thus increasing the radial stiffness of the damper elements 409A. In embodiments, a major portion (e.g., more than ½ height) of the damper elements 409A can be sunk or disposed within the corresponding hole or recess 408A in the mounting block 401 that mechanically supports the respective damper element 409A. In this sunken configuration, the height of bottom part of the damper element 409A disposed within the hole or recess 408A is greater than the height of the top part of the damper element 409A that extends above the hole or recess 408A.

In embodiments, the damper elements 409A can be configured to reduce the transmissibility of vibrations from the mounting block 401 to the accelerometer sensor 411A and thus improve survivability of the accelerometer sensor 411A in high vibration conditions. The damper elements 409A can also act as a low pass mechanical filter with regard to the measurements performed by the accelerometer sensor 411A by absorbing the energy from vibration and low shocks (0-300G) in both axial and radial orientations, thus isolating the accelerometer sensor 411A from the mounting block 401/tool housing and allowing the accelerometer sensor 411A to be in a float state thereby reducing shock or vibration input into the system from elsewhere, and as a result improving accuracy of the measurements performed by the accelerometer sensor 411A and reducing current drawn by the associated electronics.

In embodiments, the top surface of the accelerometer sensor 411A can have a cover (for example, half-circle in shape) that acts as a spacer to allow for soldering wires to the pins of the accelerometer sensor 411A as needed.

The accelerometer assembly 405B includes a shock bumper 407B, a set of damper elements (e.g., four damper elements) 409B, and an accelerometer sensor 411B. The shock bumper 407B has a top flange that extends outward from the perimeter of a cylindrical sidewall as shown. In use, the cylindrical sidewall interfaces to the annular wall of the corresponding primary recess 403B with a gap between the cylindrical sidewall and the outer sidewall of the accelerometer sensor 411B. In embodiments, this gap can be in the range of 0.125 mm to 0.425 mm, and more preferably about 0.300 mm. The top flange of the shock bumper 407B includes a set of openings (e.g., four openings) that are aligned with a corresponding set of secondary holes or recesses (e.g., four holes) 408B formed in the mounting block 401 about the periphery of the primary recess 403B. This set of secondary holes or recesses 408B of the mounting block 401 are configured to receive and mechanically support the set of damper elements (e.g., four dampers) 409B with a gap between the outer sidewalls of the damper elements 409B and the inner walls of the mounting block 401 that forms the holes or recesses 408B. In embodiments, this gap can be in the range of 0.15 mm to 0.20 mm. The set of openings in the top flange of the shock bumper 407B permit passage of the set of damper elements (e.g., four damper elements) 409B therethrough. The accelerometer sensor 411B includes a mounting flange with a set of openings that is aligned with both the secondary holes (e.g., four holes) 408B of the mounting block 401 and the openings in the top flange of the shock bumper 407B. The openings in the mounting flange of the accelerometer sensor 411B are configured to receive the set of damper elements (e.g., four damper elements) 409B (which pass through the holes in the top flange of the shock bumper 407B) and provide for mechanical coupling of the accelerometer sensor 411B to the mounting block 401 via the set of damper elements 409B disposed therebetween. In embodiments, the top portions (i.e., top posts) of the damper elements 409B can extend through the openings in the mounting flange of the accelerometer sensor 411B. Nuts (with optional washers) 419 can be mechanically fastened to such top portions (i.e., top posts) to mechanically couple the accelerometer sensor 411B to the mounting block 401 via the set of damper elements 409B disposed therebetween.

In embodiments, the shock bumper 407B can be configured to limit motion of the accelerometer sensor 411B during high shock events (such as shock events of 350 times gravity or more) and also prevent direct contact of the accelerometer sensor 411B to the mounting block 401. The shock bumper 407B can be configured to aid in absorbing energy from shock events to improve survivability of the accelerometer sensor 411B and can also prevent premature failure of the damper elements 409B due to excessive motion under high level shock events. In embodiments, the shock bumper 407B or part(s) thereof can be formed from an elastomeric material suitable for high temperature downhole conditions, such as high temperature silicon rubber and other high temperature rubber-like compounds (e.g., FKM or fluorine rubber or hydrogenated nitrile butadiene rubber, or VITON rubber). The thickness of the material of the shock bumper 407B can be varied by design. In an embodiment, the shock bumper 407B can be formed from 1.6 mm thick high temperature low compression rubber.

In embodiments, the damper elements 409B or parts thereof can be formed from a damping or elastomeric material suitable for high temperature downhole conditions, such as high temperature silicone rubber and other high temperature rubber-like compounds (e.g., FKM or fluorine rubber or hydrogenated nitrile butadiene rubber, or VITON rubber). In embodiments, the damper elements 409B can be configured such that a bottom part of the damping or elastomeric material of each respective damper element 409B is sunk or disposed within the corresponding hole or recess 408B in the mounting block 401 that mechanically supports the respective damper element 409B, and a top part of the damping or elastomeric material of each respective damper element 409B extends above the corresponding hole or recess 408B in the mounting block 401. This sunken configuration can enable the damper elements 409B to bend instead of shearing, thus increasing the radial stiffness of the damper elements 409B. In embodiments, a major portion (e.g., more than ½ height) of the damper elements 409B can be sunk or disposed within the corresponding hole or recess 408B in the mounting block 401 that mechanically supports the respective damper element 409B. In this sunken configuration, the height of bottom part of the damper element 409B disposed within the hole or recess 408B is greater than the height of the top part of the damper element 409B that extends above the hole or recess 408B.

In embodiments, the damper elements 409B can be configured to reduce the transmissibility of vibrations from the mounting block 401 to the accelerometer sensor 411B and thus improve survivability of the accelerometer sensor 411B in high vibration conditions. The damper elements 409B can also act as a low pass mechanical filter with regard to the measurements performed by the accelerometer sensor 411B by absorbing the energy from vibration and low shocks (0-300G) in both axial and radial orientations, thus isolating the accelerometer sensor 411B from the mounting block 401/tool housing and allowing the accelerometer sensor 411B to be in a float state thereby reducing shock or vibration input into the system from elsewhere, and as a result improving accuracy of the measurements performed by the accelerometer sensor 411B and reducing current drawn by the associated electronics.

In embodiments, the top surface of the accelerometer sensor 411B can have a cover (for example, half-circle in shape) that acts as a spacer to allow for soldering wires to the pins of the accelerometer sensor 411B as needed.

The accelerometer assembly 405C includes a shock bumper 407C, a set of damper elements (e.g., four damper elements) 409C, an accelerometer sensor 411C, a first mounting bracket 413, and a second mounting bracket 415 that supports a collar magnet sensor 417. The shock bumper 407C has a top flange that extends from a cylindrical sidewall as shown. In use, the cylindrical sidewall interfaces to the annular wall of the corresponding primary recess 403C with a gap between the cylindrical sidewall and the outer sidewall of the accelerometer sensor 411C. In embodiments, this gap can be in the range of 0.125 mm to 0.425 mm, and more preferably about 0.300 mm. The top flange of the shock bumper 407C includes a set of openings (e.g., four openings) that are aligned with a corresponding set of secondary holes or recesses (e.g., four holes) formed in the mounting block 401 about the periphery of the primary recess 403C. This set of secondary holes or recesses of the mounting block 401 are configured to receive and mechanically support the set of damper elements (e.g., four damper elements) 409C with a gap between the outer sidewalls of the damper elements 409C and the inner walls of the mounting block 401 that forms the holes or recesses. In embodiments, this gap can be in the range of 0.15 mm to 0.20 mm. The set of openings in the top flange of the shock bumper 407C permit passage of the set of damper elements (e.g., four damper elements) 409C therethrough. The accelerometer sensor 411C includes a mounting flange with a set of openings that is aligned with both the secondary holes (e.g., four holes) of the mounting block 401 and the openings in the top flange of the shock bumper 407C. The openings in the mounting flange of the accelerometer sensor 411C are configured to receive the set of damper elements (e.g., four damper elements) 409C (which pass through the holes in the top flange of the shock bumper 407C) and provide for mechanical coupling of the accelerometer sensor 411C to the mounting block 401 via the set of damper elements 409C disposed therebetween. In embodiments, the top portions (i.e., top posts) of the damper elements 409C can extend through the openings in the mounting flange of the accelerometer sensor 411C. Nuts (with optional washers) 419 can be mechanically fastened to such top portions (i.e., top posts) to mechanically couple the accelerometer sensor 411C to the mounting block 401 via the set of damper elements 409C disposed therebetween. The first mounting bracket 413 and the second mounting bracket 415 are mechanically coupled to the mounting flange of the accelerometer sensor 411C and configured to support the collar magnet sensor 417 in a position spaced from the top of the accelerometer sensor 411C as shown. The collar magnet sensor 417 can be used to measure rotation speed (RPM) of the mounting block 401/tool housing during drilling operations.

In embodiments, the shock bumper 407C can be configured to limit motion of the accelerometer sensor 411C during high shock events (such as shock events of 350 times gravity or more) and also prevent direct contact of the accelerometer sensor 411C to the mounting block 401. The shock bumper 407C can be configured to aid in absorbing energy from shock events to improve survivability of the accelerometer sensor 411C and can also prevent premature failure of the damper elements 409C due to excessive motion under high level shock events. In embodiments, the shock bumper 407C or part(s) thereof can be formed from an elastomeric material suitable for high temperature downhole conditions, such as high temperature silicon rubber and other high temperature rubber-like compounds (e.g., FKM or fluorine rubber or hydrogenated nitrile butadiene rubber, or VITON rubber). The thickness of the material of the shock bumper 407C can be varied by design. In one embodiment, the shock bumper 407C can be formed from 1.6 mm thick high temperature low compression rubber.

In embodiments, the damper elements 409C or parts thereof can be formed from a damping or elastomeric material suitable for high temperature downhole conditions, such as high temperature silicone rubber and other high temperature rubber-like compounds (e.g., FKM or fluorine rubber or hydrogenated nitrile butadiene rubber, or VITON rubber). In embodiments, the damper elements 409C can be configured such that a top part of the damping or elastomeric material of each respective damper element 409C is sunk or disposed within the corresponding hole or recess in the mounting block 401 that mechanically supports the respective damper element 409C, and a top part of the damping or elastomeric material of each respective damper element 409C extends above the corresponding hole or recess 408C in the mounting block 401. This sunken configuration can force the damper elements 409C to bend instead of shearing, thus increasing the radial stiffness of the damper elements 409C. In embodiments, a major portion (e.g., more than ½ height) of the damper elements 409C can be sunk or disposed within the corresponding hole or recess 408C in the mounting block 401 that mechanically supports the respective damper element 409C. In this sunken configuration, the height of bottom part of the damper element 409C disposed within the hole or recess 408C is greater than the height of the top part of the damper element 409C that extends above the hole or recess 408C.

In embodiments, the damper elements 409C can be configured to reduce the transmissibility of vibrations from the mounting block 401 to the accelerometer sensor 411C and thus improve survivability of the accelerometer sensor 411C in high vibration conditions. The damper elements 409C can also act as a low pass mechanical filter with regard to the measurements performed by the accelerometer sensor 411C by absorbing the energy from vibration and low shocks (0-300G) in both axial and radial orientations, thus isolating the accelerometer sensor 411C from the mounting block 401/tool housing and allowing the accelerometer sensor 411C to be in a float state thereby reducing shock or vibration input into the system from elsewhere, and as a result improving accuracy of the measurements performed by the accelerometer sensor 411C and reducing current drawn by the associated electronics.

In embodiments, the top surface of the accelerometer sensor 411C can have a cover (for example, half-circle in shape) that acts as a spacer to allow for soldering wires to the pins of the accelerometer sensor 411C as needed.

Figure 10:
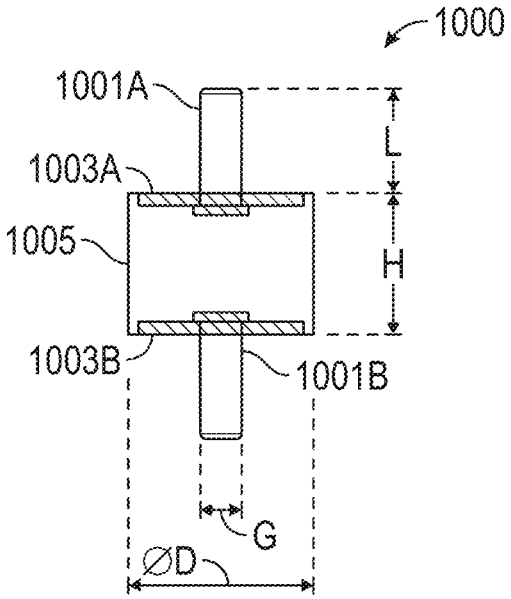
FIG. 10 is a schematic diagram of a turret-mounted damper element.

In embodiments, the damper elements 409A, 409B, 409C can be turret-mounted damper elements, such as the turret-mounted damper element 1000 of FIG. 10. The damper element 1000 includes a top post 1001A and a bottom post 1001B that extend from top and bottom plates 1003A, 1003B, respectively, which are mounted to opposed surfaces of a cylindrical damping structure 1005. The cylindrical damping structure 1005 can be formed from a damping or elastomeric material suitable for high temperature downhole conditions as described herein. In embodiments, the damping structure 1005 can be configured such that a major portion (e.g., more than half of height H) of the damping structure 1005 is sunk or disposed within the corresponding hole or recess in the mounting block 401 that mechanically supports the damper element. This sunken configuration forces the damping structure 1005 to bend instead of shearing, thus increasing its radial stiffness of the damper element. In embodiments, the damping structure 1005 and corresponding hole or recess in the mounting block 401 can be configured with a gap between the outer sidewall of the damping structure 1005 and the inner wall of the mounting block 401 that forms the corresponding hole or recess. In embodiments, this gap can be in the range of 0.15 mm to 0.20 mm.

Figure 11:
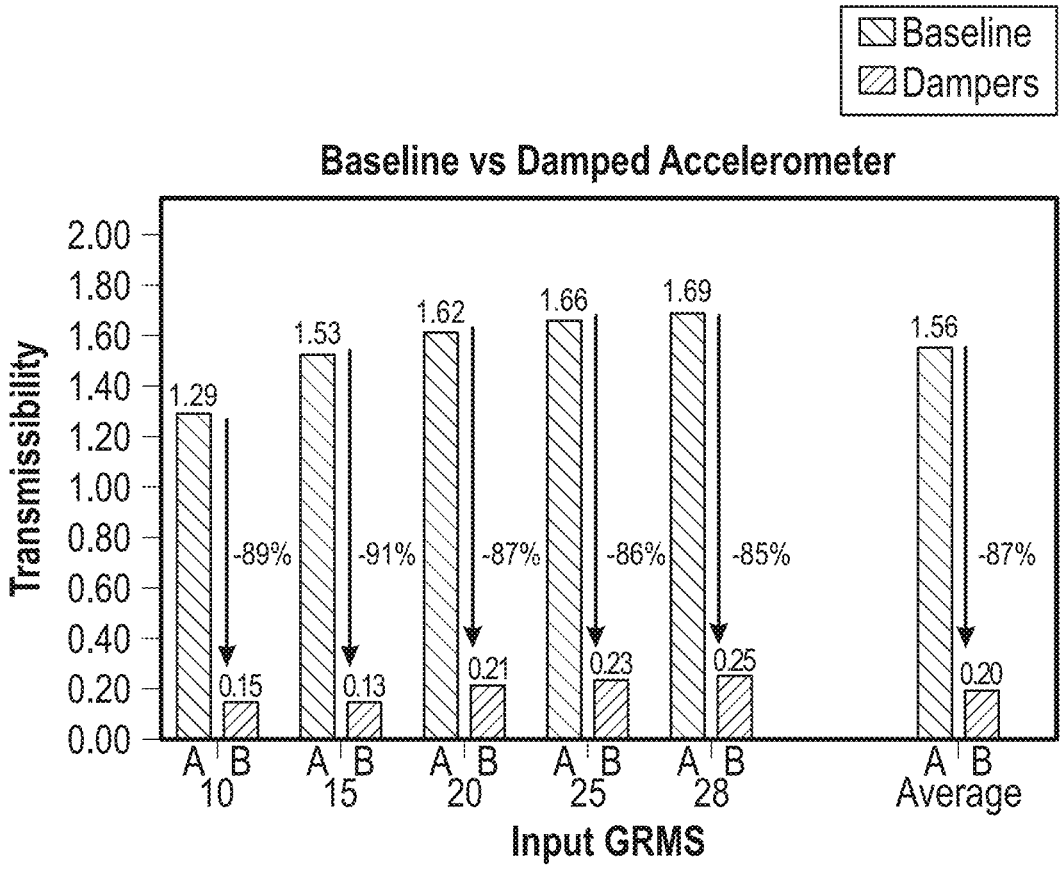
FIG. 11 depicts plots of vibrations transmissibility for a baseline design (without damper elements) and for a design with the damper elements of the present disclosure over varying vibrations (input GRMS) as well as a plot of average vibration transmissibility.
Figure 12:
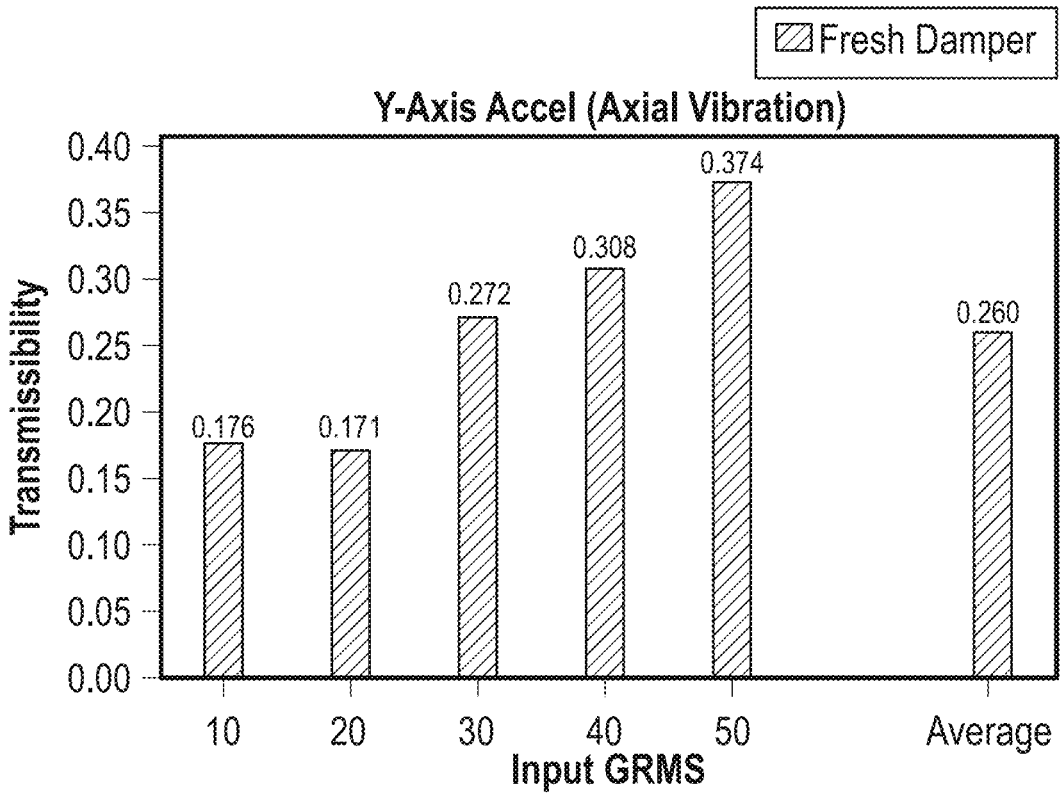
FIG. 12 depicts plots of vibration transmissibility of the damper elements of the accelerometer assembly 405B of FIGS. 4 to 9 over varying axial vibration (input GRMS) as well as a plot of average vibration transmissibility of the accelerometer assembly 405B of FIGS. 4 to 9 to axial vibration.
Figure 13:
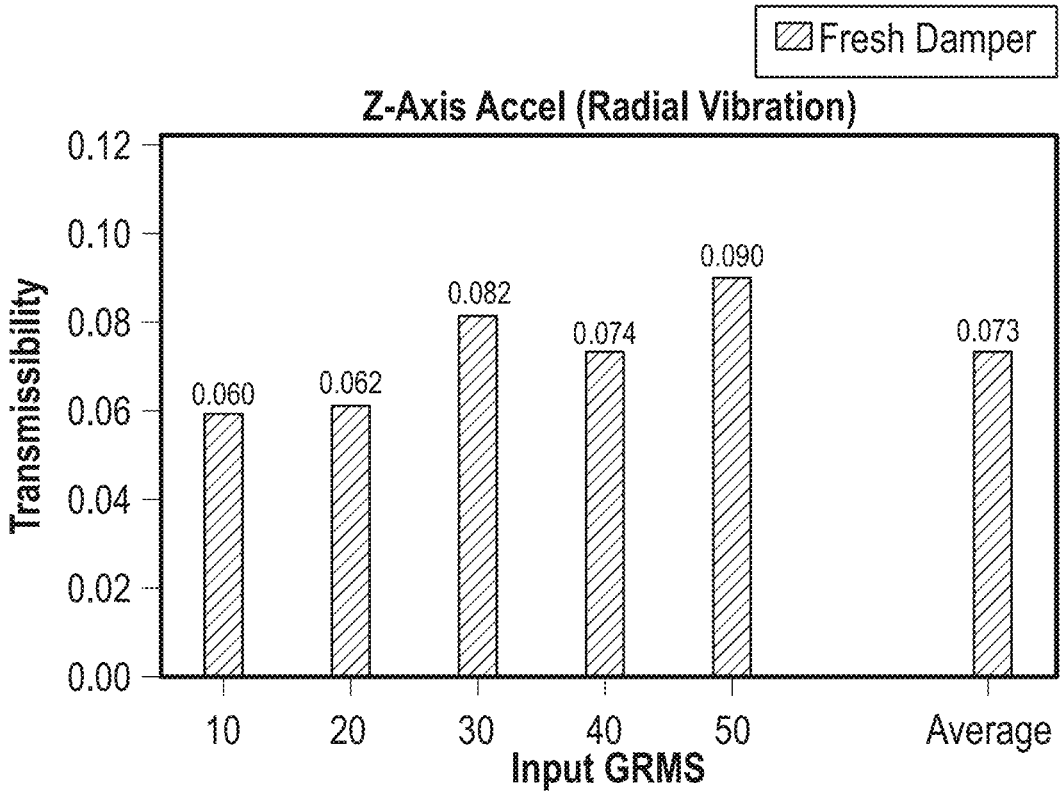
FIG. 13 depicts plots of vibration transmissibility of the damper elements of the accelerometer assembly 405A of FIGS. 4 to 9 over varying radial vibration (input GRMS) as well as a plot of average vibration transmissibility of the accelerometer assembly 405A of FIGS. 4 to 9 to radial vibration.

Multiple tests were conducted to evaluate the effectiveness of the vibration damping afforded by the damper elements of the present disclosure. FIG. 11 depicts plots of vibration transmissibility for a baseline design (without damper elements) and for a design with the damper elements of the present disclosure over varying vibrations (input GRMS) as well as a plot of average vibration transmissibility. FIG. 12 depicts plots of vibration transmissibility of the damper elements of the accelerometer assembly 405B of FIGS. 4 to 9 over varying axial vibration (input GRMS) as well as a plot of average vibration transmissibility of the accelerometer assembly 405B of FIGS. 4 to 9 to axial vibration. FIG. 13 depicts plots of vibration transmissibility of the damper elements of the accelerometer assembly 405C of FIGS. 4 to 9 over varying radial vibration (input GRMS) as well as a plot of average vibration transmissibility of the accelerometer assembly 405C of FIGS. 4 to 9 to radial vibration. The results of FIGS. 11, 12 and 13 are very positive as they show that the design with the damper elements of FIGS. 4 to 9 reduces vibration transmissibility by approximately 90%.

Figure 14A:
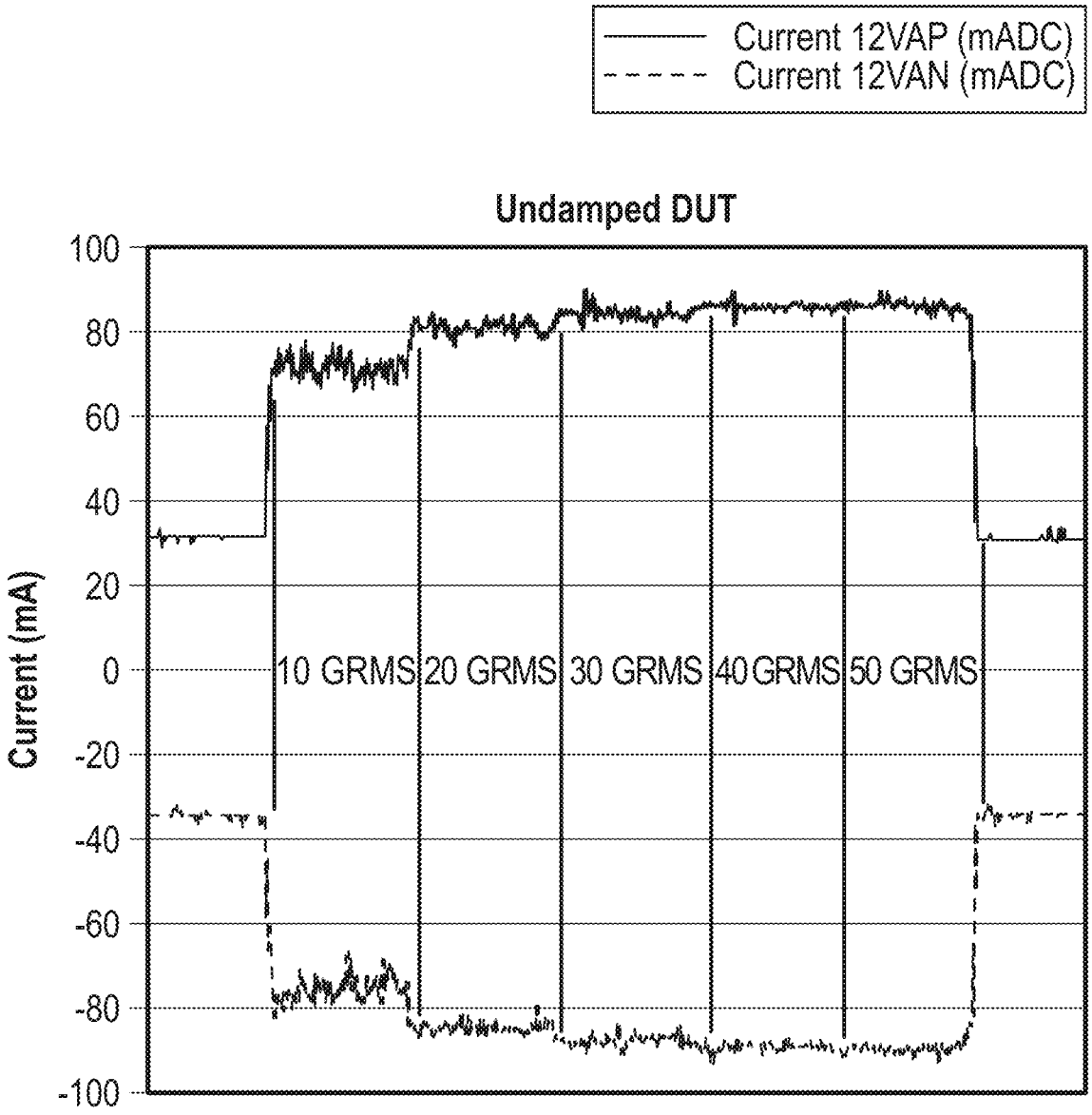
FIG. 14A depicts plots of accelerometer sensor current drawn by a baseline design (without damper elements)
Figure 14B:
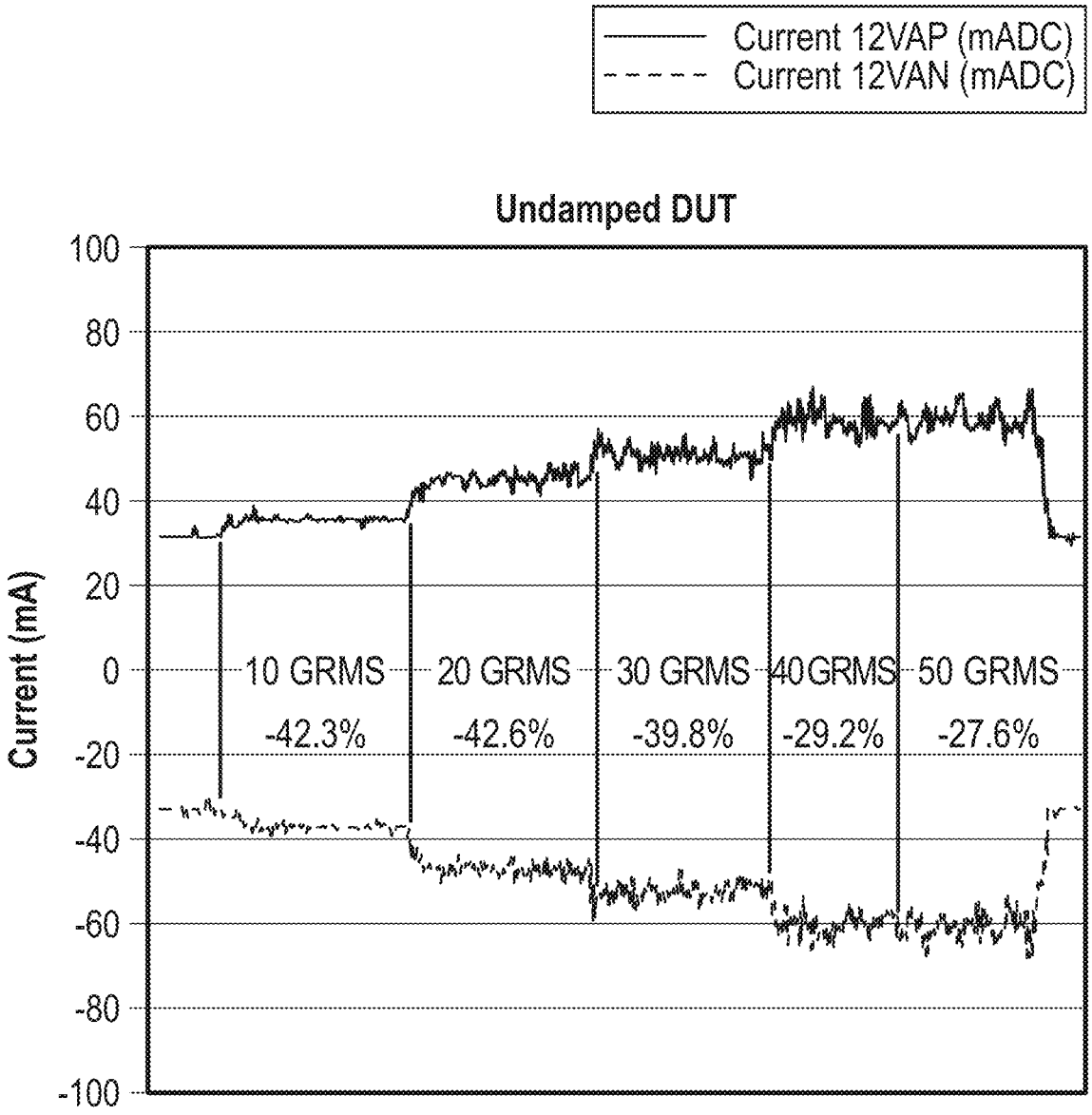
FIG. 14B depicts plots of accelerometer sensor current drawn by a design with the damper elements of the present disclosure.

Note that the accelerometer sensors 411A, 411B, 411C convert acceleration (G) into milliamps (mA). By adding the damper elements of the present disclosure, the accelerometer sensors 411A, 411B, 411C experience significantly less unwanted vibration and hence draws a much lower current. FIG. 14A depicts current drawn by a baseline design (without damper elements). FIG. 14B depicts current drawn by a design with the damper elements of the present disclosure. The results of FIG. 14B show an average of 37% lower current drawn by the design with the damper elements of the present disclosure. This means that the added damper elements of the present disclosure can reduce tool power consumption and reduce electrical stress in associated electronic circuitry.

Figures 15A, 15B, 15C:
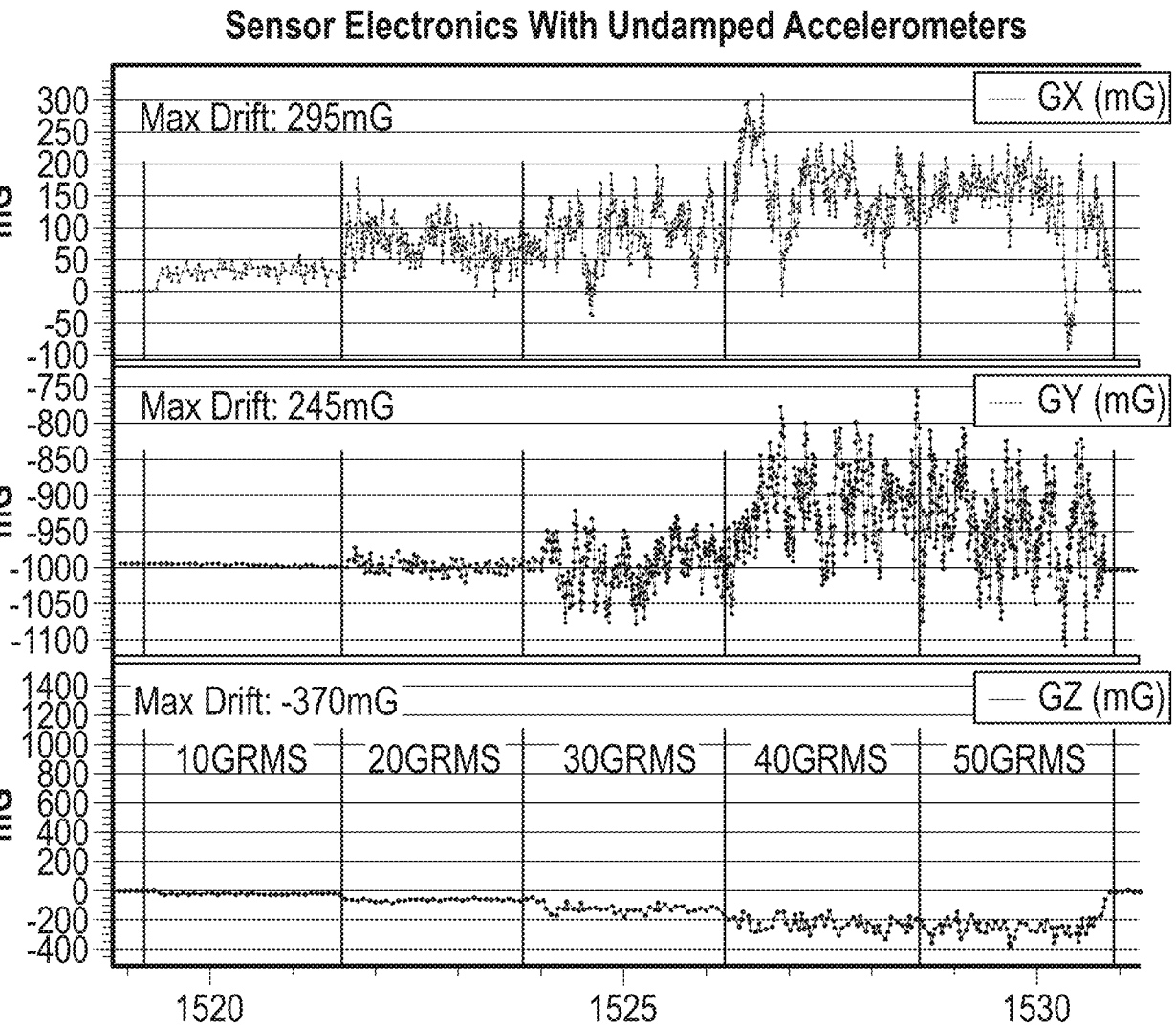
FIGS. 15A, 15B, 15C depict plots of the drift in accelerometer readings produced by a baseline design (without damper elements)
Figures 16A, 16B, 16C:
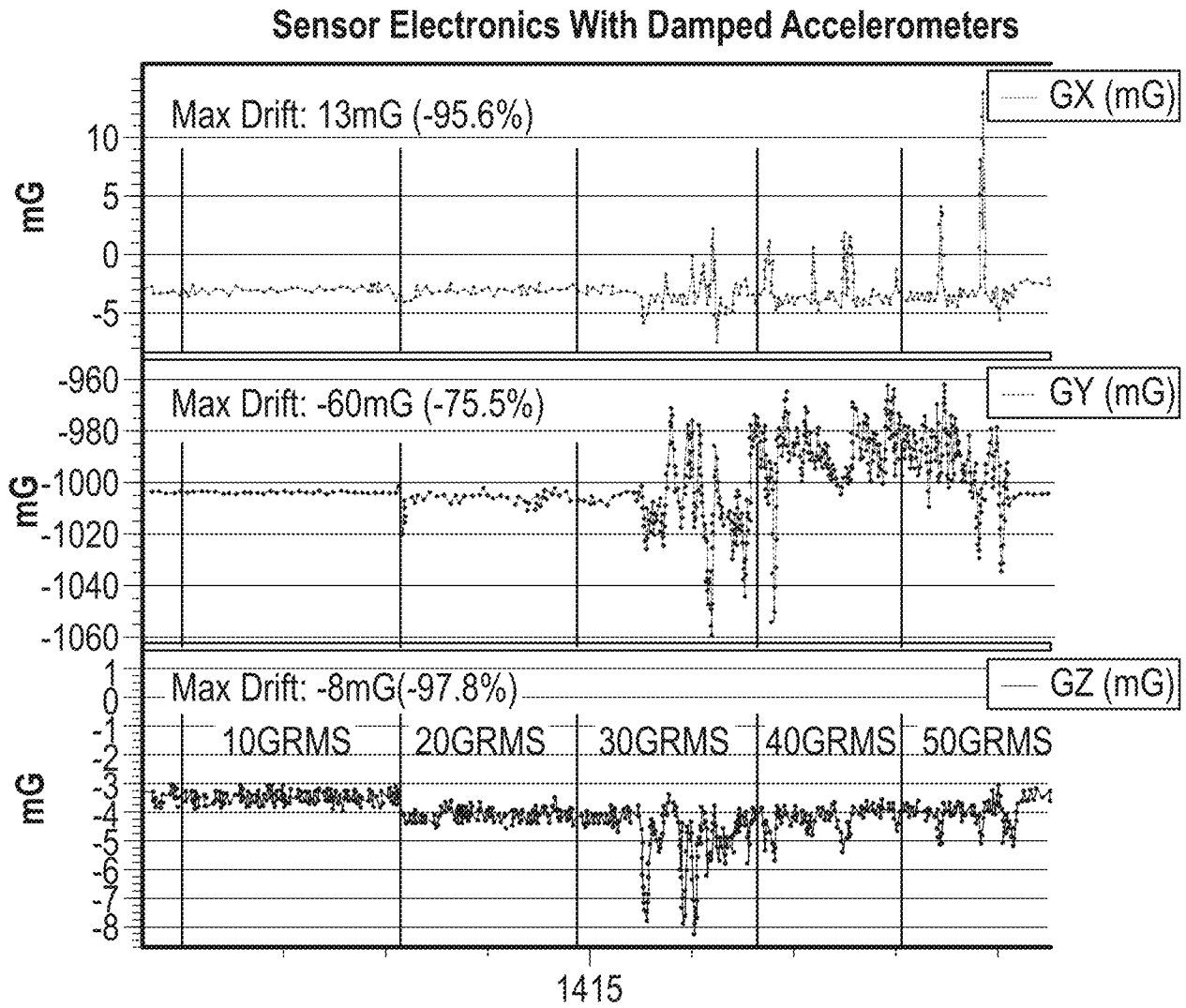
FIGS. 16A, 16B, 16C depict plots of the drift in accelerometer readings produced by a design with the damper elements of the present disclosure.

The damper elements of the present disclosure can also provide for more accurate and stable accelerometer readings by reducing drift and acting as a mechanical low pass filter with regard to the measurements performed by the accelerometer sensors (currently all low pass filtering is done electrically). FIGS. 15A, 15B, 15C depict plots of drift in accelerometer readings produced by a baseline design (without damper elements). FIGS. 16A, 16B, 16C depict plots of drift in accelerometer readings produced by a design with the damper elements of the present disclosure. The results of FIGS. 16A, 16B, 16C show a reduction in the drift of about 90 percent as produced by the design with the damper elements of the present disclosure. This means that the added damper elements of the present disclosure can reduce drift and increase reading accuracy of the accelerometer in high shock and vibration conditions.

The shock bumpers of the present disclosure can help reduce radial shock transmissibility. For example, test results show that the shock bumpers of the present disclosure reduce radial shock transmissibility by 18.8% as compared to a baseline design without shock bumpers. This helped achieve a radial shock transmissibility of 1.6 consistently at any shock input. The latest design was able to produce transmissibility of 0.92 thus reducing shock transmissibility by 46% compared with the baseline setup.

Figure 17:
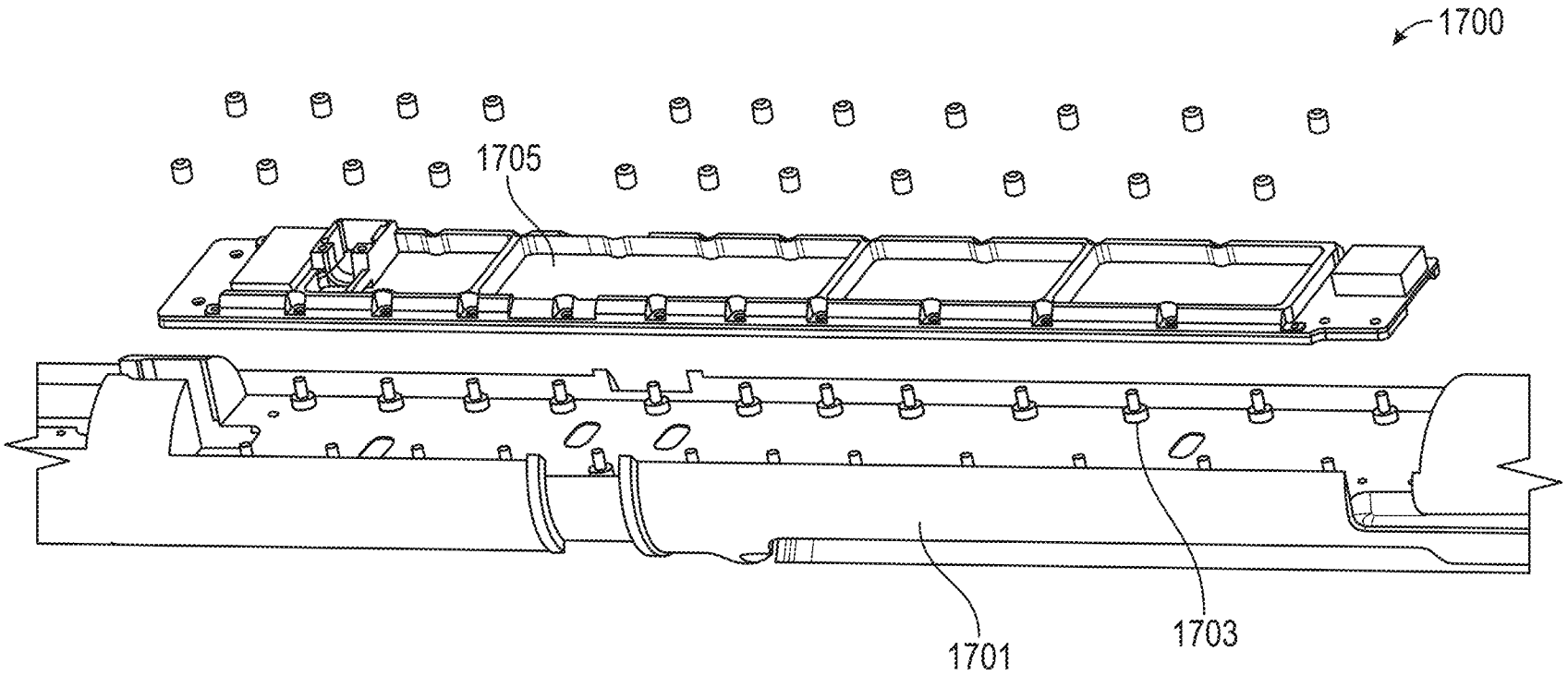
FIGS. 17 to 19 are schematic diagrams of parts of a downhole tool that can embody other aspects of the present disclosure.
Figure 18:
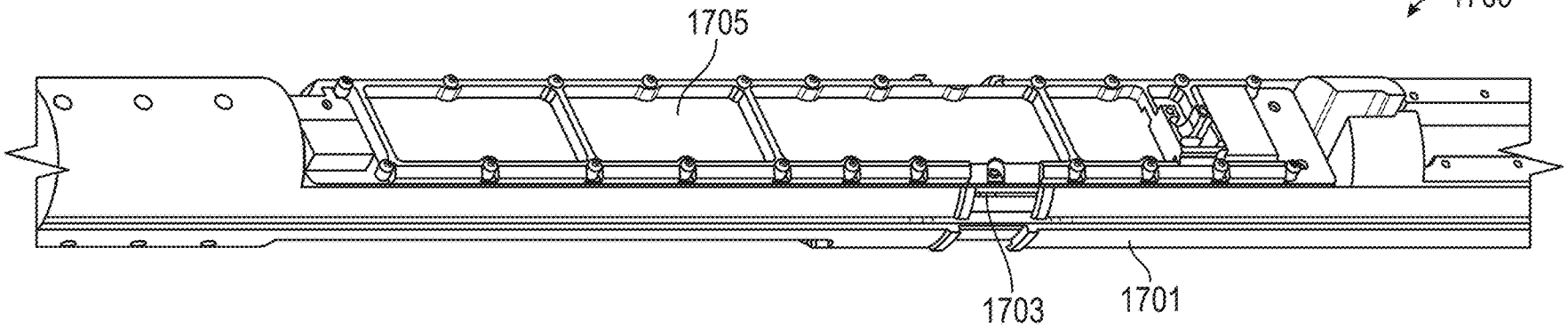
Figure 19:
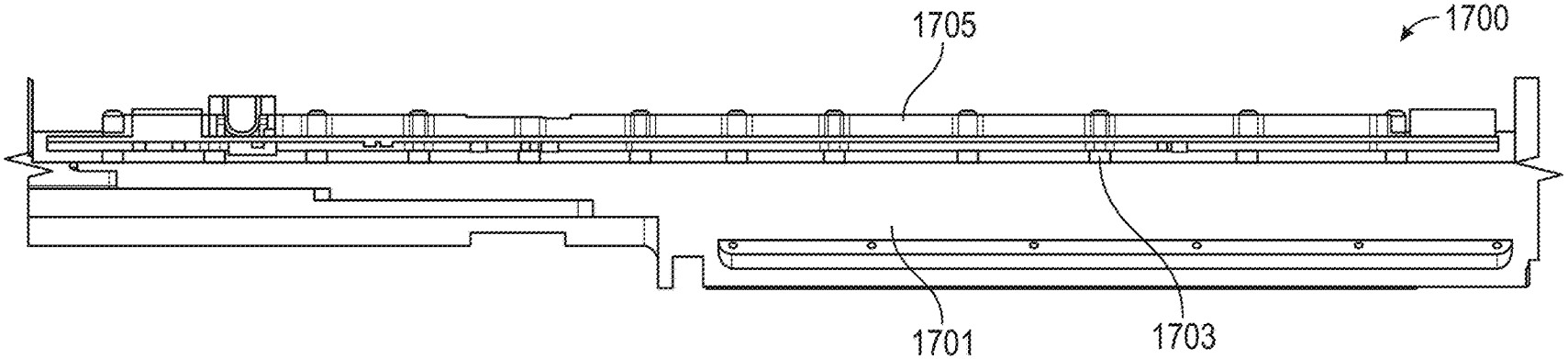

FIGS. 17 to 19 are schematic diagrams of part of a downhole tool that can embody other aspects of the present disclosure. For example, the part can be a component of an RSS or MWD tool or a LWD tool, such as a component of the RSS 32 of FIG. 1, a component of the sensor package and control system of the point-the-bit RSS 32' of FIG. 2, a component of the control unit 303 of the push-the-bit RSS 32" of FIG. 3, a component of the MWD sub 28 of FIG. 2, or a component of the LWD sub 30 of FIG. 2. The part 1700 includes a chassis 1701 of the downhole tool. As shown in FIG. 17, the chassis 1701 includes an array of recesses or holes that are configured to receive and mechanically support damper elements 1703 with a gap between the outer sidewalls of the damper elements 1703 and the inner walls of the chassis 1701 that forms the array of holes or recesses. In embodiments, this gap can be in the range of 0.15 mm to 0.20 mm. The array of holes or recesses of the chassis 1701 are aligned with corresponding openings disposed about the periphery of an electronic assembly 1705, such as a printed wire assembly or printed circuit board. The openings in the electronic assembly 1705 permit passage of the top portion (e.g., top posts) of the damper elements 1703 therethrough. The openings in the electronic assembly 1705 are configured to receive the damper elements 1703 and provide for mechanical coupling of the electronic assembly 1705 to the chassis 1701 via the damper elements 1703 disposed therebetween.

In embodiments, the damper elements 1703 or parts thereof can be formed from a damping or elastomeric material suitable for high temperature downhole conditions, such as high temperature silicone rubber and other high temperature rubber-like compounds (e.g., FKM or fluorine rubber or hydrogenated nitrile butadiene rubber, or VITON rubber). In embodiments, the damper elements 1703 can be configured such that part of the damping or elastomeric material of each respective damper element 1703 is sunk or disposed within the corresponding hole or recess in the chassis 1701 that mechanically supports the respective damper element 1703. This sunken configuration can force the damper elements 1703 to bend instead of shearing, thus increasing the radial stiffness of the damper elements 1703. In embodiments, a major portion (e.g., more than ½ height) of the damper elements 1703 can be sunk or disposed within the corresponding hole or recess in the chassis 1701 that mechanically supports the respective damper element 1703.

In embodiments, the damper elements 1703 can be configured to reduce the transmissibility of vibrations from the chassis 1701 to the electronic assembly 1705 and thus improve survivability of the electronic assembly 1705 in high vibration conditions. The damper elements 1703 can also act as a low pass mechanical filter with regard to the measurements performed by components of the electronic assembly 1705 by absorbing the energy from vibration and low shocks (0-300G) in both axial and radial orientations, thus isolating the electronic assembly 1705 and its components from the chassis 1701 and allowing the electronic assembly 1705 to be in a float state thereby reducing shock or vibration input into the system from elsewhere.

In embodiments, the damper elements 1703 can be turret-mounted damper elements, such as the turret-mounted damper element 1000 described above with respect to FIG. 10.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claims expressly use the words 'means for' together with an associated function.

What is claimed is:

1. A downhole tool for use while drilling a wellbore in a subterranean formation, comprising:

a first component selected from the group consisting of a mounting block and a chassis, wherein the first component experiences vibrations while drilling;

at least one sensor mechanically coupled to the first component by at least one vibration damper element; and at least one shock bumper that surrounds a corresponding sensor, wherein the shock bumper is configured to absorb shock experienced by the first component while drilling.

2. The downhole tool of claim 1, wherein:

the vibration damper element is arranged in a sunken configuration wherein a first part of damping material of the vibration damper element is disposed within a recess in the first component, and a second part of the damping material of the vibration damper element extends above the recess in the first component.

3. The downhole tool of claim 2, wherein:

the damping material of the first part of the vibration damper element is more than the damping material of the second part of the vibration damper element.

4. The downhole tool of claim 2, wherein:

the recess is defined by a hole in the first component.

5. The downhole tool of claim 1, wherein:

the at least one sensor is mechanically coupled to the first component by a plurality of vibration damper elements.

6. The downhole tool of claim 1, wherein:

the at least one sensor comprises an accelerometer sensor.

7. The downhole tool of claim 1, wherein:

the at least one vibration damper element is configured to reduce current drawn by the at least one sensor.

8. The downhole tool of claim 1, wherein:

the at least one vibration damper element is configured to reduce drift in the measurements performed by the at least one sensor.

9. The downhole tool of claim 1, wherein:

the at least one vibration damper element acts as a mechanical low pass filter with regards to measurements performed by the at least one sensor.

10. The downhole tool of claim 1, wherein:

the at least one vibration damper element comprises a turret-mounted damper element that includes a top post and a bottom post that extend from top and bottom plates, respectively, which are mounted to opposed surfaces of a cylindrical damping structure.

11. The downhole tool of claim 1, wherein:

the downhole tool comprises a tool selected from the group consisting of a rotary steerable system, a measurement-while drilling tool, a logging-while drilling tool, or other downhole tool.

12. A downhole tool for use while drilling a wellbore in a subterranean formation, comprising:

a mounting block that experiences vibrations while drilling, wherein the mounting block includes at least one primary recess configured to receive a corresponding sensor and a plurality of secondary recesses disposed about the primary recess;

wherein the at least one sensor is mechanically coupled to the mounting block by a plurality of vibration damper elements disposed within the plurality of secondary recesses.

13. The downhole tool of claim 12, wherein:

at least one of the plurality of vibration damper elements is arranged in a sunken configuration wherein a first part of damping material of the respective vibration damper element is disposed within a corresponding secondary recess, and a second part of the damping material of the respective vibration damper element extends above the corresponding secondary recess.

14. The downhole tool of claim 13, wherein:

the damping material of the first part of the respective vibration damper element is larger than the damping material of the second part of the respective vibration damper element.

15. The downhole tool of claim 12, further comprising:

a shock bumper disposed within the primary recess and surrounding the corresponding sensor, wherein the shock bumper is configured to absorb shock experienced by the mounting block while drilling.

16. The downhole tool of claim 12, wherein:

the at least one sensor comprises an accelerometer sensor.

17. The downhole tool of claim 12, wherein:

the plurality of vibration damper elements is configured to reduce current drawn by the at least one sensor.

18. The downhole tool of claim 12, wherein:

at least one of the plurality of vibration damper elements comprises a turret-mounted damper element that includes a top post and a bottom post that extend from top and bottom plates, respectively, which are mounted to opposed surfaces of a cylindrical damping structure.

19. The downhole tool of claim 12, wherein:

the downhole tool comprises a tool selected from the group consisting of a rotary steerable system, a measurement-while drilling tool, a logging-while drilling tool, or other downhole tool.

20. The downhole tool of claim 12, wherein:

the plurality of vibration damper elements is configured to reduce drift in the measurements performed by the at least one sensor.

21. The downhole tool of claim 12, wherein:

the plurality of vibration damper elements acts as a mechanical low pass filter with regards to measurements performed by the at least one sensor.

22. A downhole tool for use while drilling a wellbore in a subterranean formation, comprising:

a first component selected from the group consisting of a mounting block and a chassis, wherein the first component experiences vibrations while drilling; and an electronics assembly mechanically coupled to the first component by at least one vibration damper element, wherein the at least one vibration damper element comprises a turret-mounted damper element that includes a top post and a bottom post that extend from top and bottom plates, respectively, which are mounted to opposed surfaces of a cylindrical damping structure.

23. The downhole tool of claim 22, wherein:

the vibration damper element is arranged in a sunken configuration wherein a first part of the cylindrical damping structure is disposed within a recess in the first component, and a second part of the cylindrical damping structure extends above the recess in the first component.

24. The downhole tool of claim 22, wherein:

the electronics assembly is mechanically coupled to the first component by a plurality of vibration damper elements, wherein the plurality of vibration damper elements comprise a plurality of turret-mounted damper elements that each include a top post and a bottom post that extend from top and bottom plates, respectively, which are mounted to opposed surfaces of a cylindrical damping structure.

* * * * *